US006843730B1

(12) United States Patent
Bellagamba

(10) Patent No.: US 6,843,730 B1
(45) Date of Patent: Jan. 18, 2005

(54) GOLF TRAINING APPARATUS

(76) Inventor: Miro D. Bellagamba, 5161 Vineland Blvd., Orlando, FL (US) 32811

( * ) Notice: Subject to any disclaimer, the term of this patent is extended or adjusted under 35 U.S.C. 154(b) by 0 days.

(21) Appl. No.: 10/639,968

(22) Filed: Aug. 12, 2003

Related U.S. Application Data

(60) Provisional application No. 60/402,902, filed on Aug. 13, 2002.

(51) Int. Cl.[7] ..... A63B 69/36

(52) U.S. Cl. ..... 473/216; 473/208; 473/215; 473/207

(58) Field of Search ..... 473/266, 268, 473/274, 275, 277, 207, 208, 215, 216

(56) References Cited

U.S. PATENT DOCUMENTS

| | | | | | |
|---|---|---|---|---|---|
| 1,530,519 | A | * | 3/1925 | Remington | 473/216 |
| 1,936,143 | A | * | 11/1933 | Shea | 473/208 |
| 2,611,610 | A | * | 9/1952 | Rikuo | 473/271 |
| 2,737,432 | A | * | 3/1956 | Troutman | 346/44 |
| 4,318,546 | A | * | 3/1982 | Chen | 473/216 |
| 4,593,909 | A | * | 6/1986 | Anselmo et al. | 473/216 |
| 4,852,881 | A | | 8/1989 | Bellagamba | |
| 4,949,974 | A | | 8/1990 | Bellagamba | |
| 5,024,443 | A | | 6/1991 | Bellagamba | |
| 5,026,065 | A | | 6/1991 | Bellagamba | |
| 5,048,836 | A | | 9/1991 | Bellagamba | |
| 5,069,456 | A | | 12/1991 | Bellagamba | |
| D336,121 | S | | 6/1993 | Bellagamba | |
| 5,634,858 | A | | 6/1997 | Bellagamba | |
| 5,984,797 | A | * | 11/1999 | Kessler et al. | 473/216 |
| 6,575,844 | B1 | * | 6/2003 | Gray | 473/277 |

* cited by examiner

*Primary Examiner*—Raleigh W. Chiu
(74) *Attorney, Agent, or Firm*—William M. Hobby, III

(57) ABSTRACT

A golf training apparatus has a frame having a base and an upright frame portion having a cross frame member. A back support is attached to the upright frame portion and positioned to support the back of a golfer making practice swings and includes a Velcro fastener portion attached thereto. A belt for attaching around a golfer has a VELCRO fastener portion positioned in the back thereof and aligned for attachment to the back support fastener portion to thereby removably hold a golfer making practice swings to the golf training apparatus. The golf training apparatus includes a pair of knee brace members for holding a golfer's knees in position during a practice swing and an elongated arm with a head support yoke on the end thereof for supporting a golfer's head during practice swings.

13 Claims, 2 Drawing Sheets

GOLF TRAINING APPARATUS

This application claims the benefit of U.S. Provisional Appl. 60/402,902, filed Aug. 13, 2002.

BACKGROUND OF THE INVENTION

The present invention relates to a golf training apparatus and especially to a training apparatus which positions a golfer's body and head in alignment for practice swings.

In the past, it has been common to provide a wide variety of training devices for golfers. Many of these devices are directed towards training a golfer with a golf club swing guide which may include a frame for sliding a golf club upon or, alternatively, may hold a golf club during the swing for directing a golf club in the correct swing pattern. These types of devices may be seen in Applicant's prior U.S. patents for Golf Training Apparatus, U.S. Pat. No. 4,949,974 and U.S. Pat. No. 4,852,881. U.S. Pat. No. 5,069,456 is for a golf training apparatus having a swing guide which includes multiple telescoping adjustments. Other types of swing practice devices for golfers may be seen in Applicant's prior U.S. Pat. No. 5,048,836 for an Athletic Swing Practice Apparatus which supports the golfer with a lower back support belt with flexible straps and supported between resilient cord members to help control the golfer's stroke. Similarly, prior U.S. Pat. No. 5,024,443, for an Athletic Swing Practice Device controls the golfer's arms by strapping them together and supporting them with a resilient cord to enhance the practice stroke of the golfer. Another prior art golf training device may be seen in the Applicant's prior U.S. Pat. No. 5,026,065 for a Simplified Golf Swing Training Device for guiding the movement of a golf club. Design U.S. Pat. No. Des 336,121 shows a golf club swing guide design. Applicant's prior U.S. Pat. No. 5,634,858 teaches a golf training apparatus which holds a person's head while positioning the golfer's body in alignment for a practice swing. In addition to Applicant's prior golf training devices, it has also been suggested to have training devices which position the head of the golfer during the practice swing and various aligning devices for aligning and levelling a club have been suggested. There are also various devices for positioning the feet of the golfer in the correct stance for making the proper golf stroke.

The present invention is for an improved golf training system which is readily adjustable for different golfers and which attaches to a golfer's head to hold the head in position while at the same time positioning the feet, legs and rear side of a golfer to provide the proper stance in an overall system for multiple positioning of the golfer while making practice swings.

SUMMARY OF THE INVENTION

A golf training apparatus has a frame having a base and an upright frame portion having a cross frame member. A back support is attached to the upright frame portion and positioned to support the back of a golfer making practice swings and includes a fastener portion attached thereto. A belt for attaching around a golfer has a fastener portion positioned in the back thereof and aligned for attachment to the back support fastener portion to thereby removably hold a golfer making practice swings to the golf training apparatus. The golf training apparatus includes a pair of knee brace members adjustably attached to and extending from the frame upright frame portion for holding a golfer's knees in position during a practice swing. Each knee brace member has both a knee side member and a knee back member. The upright frame portion of the frame has a plurality of telescoping members for adjusting the golf training apparatus to a specific golfer making practice swings. The back support fastener portion is one side of an elongated strip of hook and loop material while the belt fastener portion is a matching elongated strip of hook and loop material which removably attaches to the back support fastener portion elongated strip of hook and loop material so as to partially separate when a golfer makes a practice swing, thereby applying a releasably force to the golfer as he swings a golf club. The golf training apparatus also includes an elongated head supporting arm attached to and extending from the frame to an area adjacent a golfer making a practice swing's head. The head supporting arm has a head supporting yoke attached thereto and may be supporting the head from the back or from the top while the golfer is making a practice swing.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
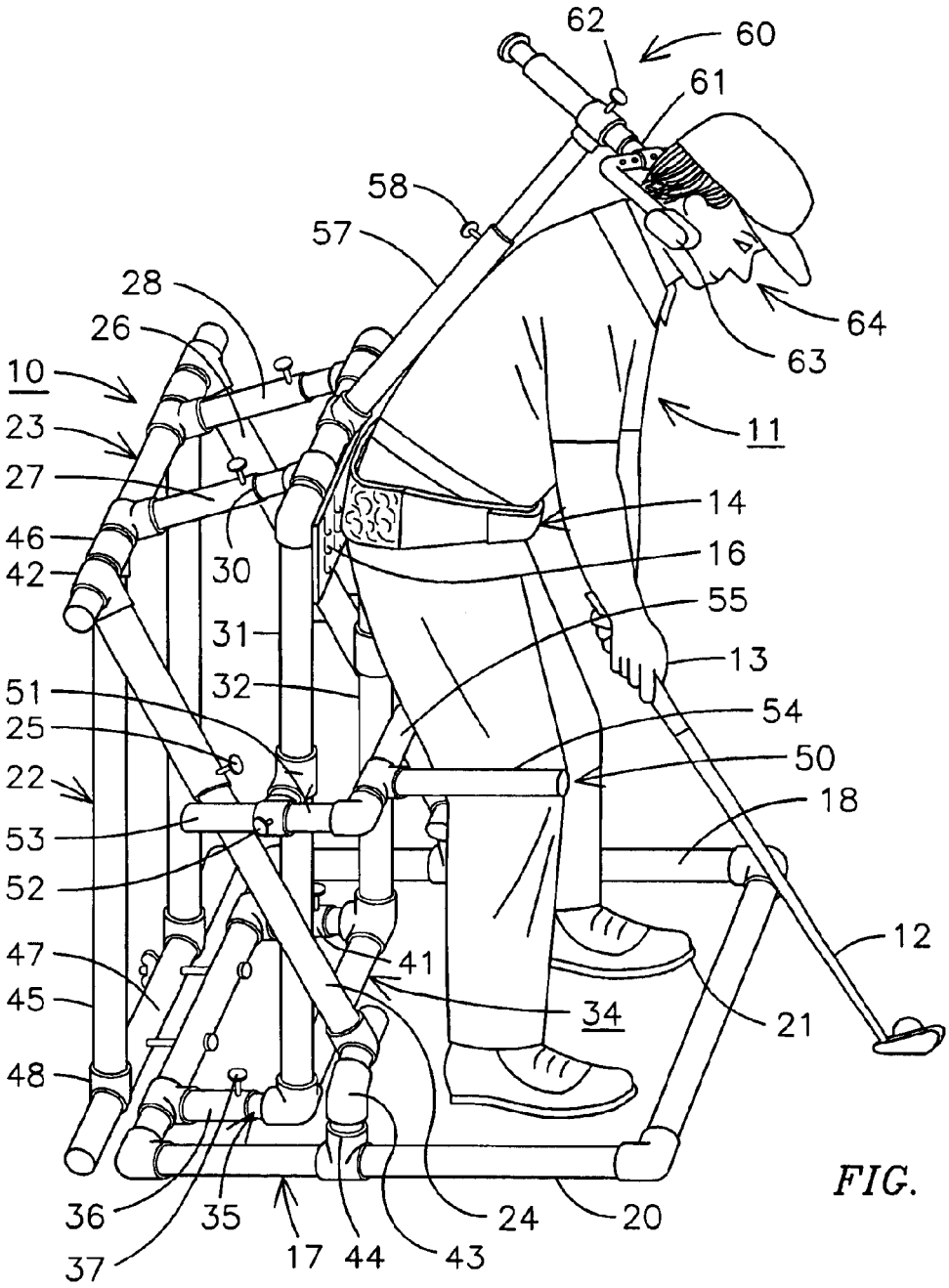
FIG. 1 is a perspective view of a golfer using the golf training apparatus for the present invention.
Figure 3:
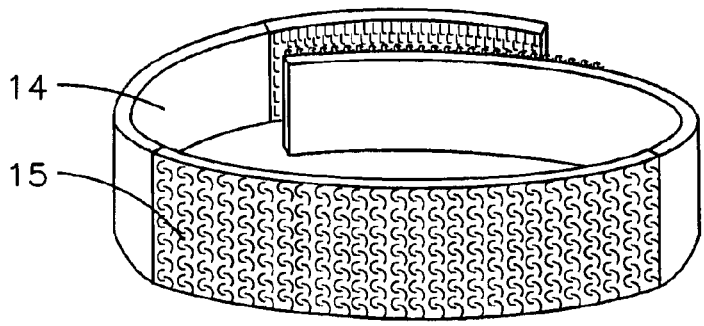
FIG. 3 is a perspective view of a golfer belt forming a part of the golf training apparatus of FIG. 1.
Figure 2:
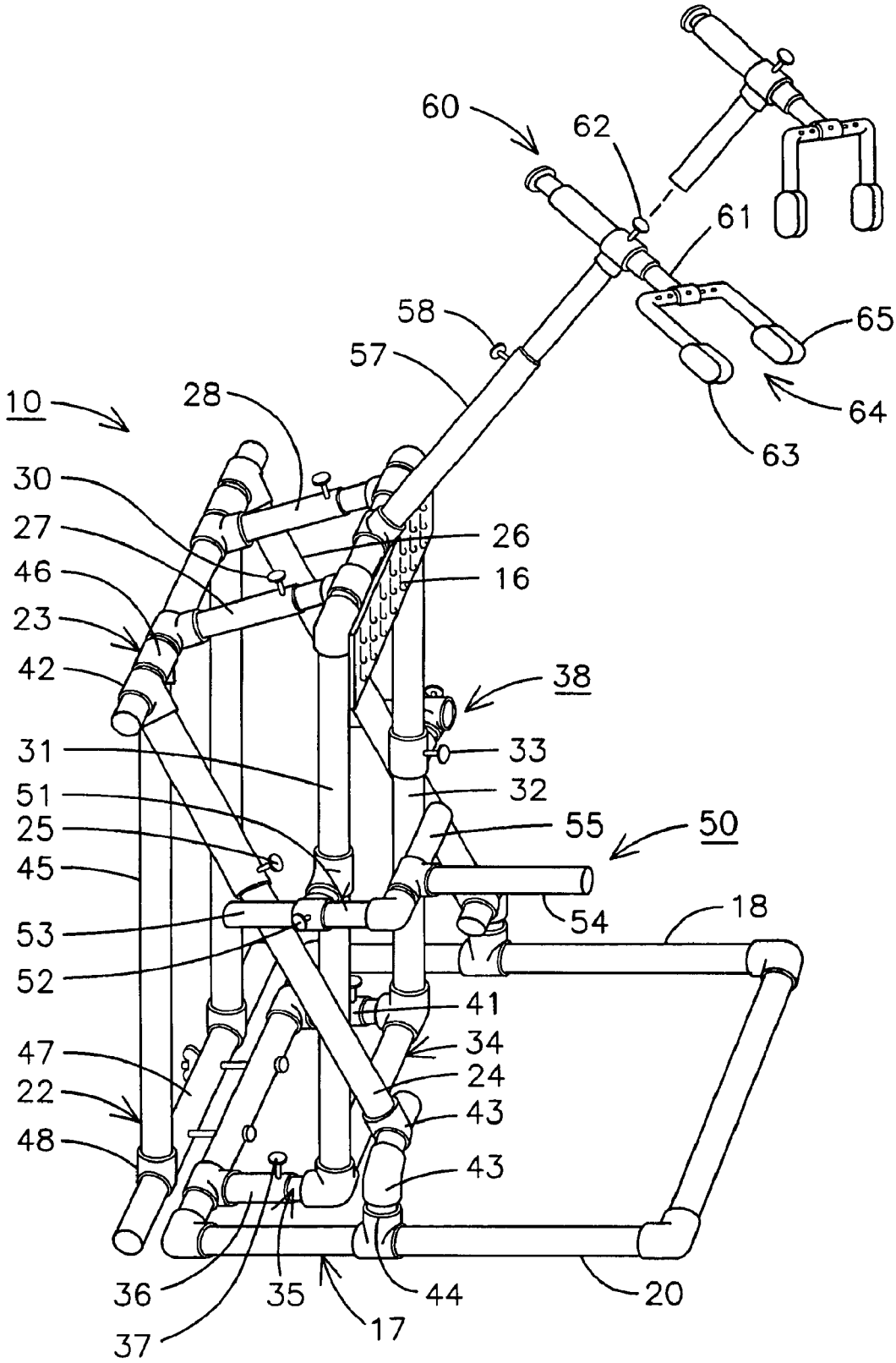
FIG. 2 is a perspective view of the golf training apparatus of FIG. 1.

Referring to FIGS. 1–3 of the drawings, a golf training apparatus 10, in accordance with the present invention, has a golfer 11 therein practicing swings in FIG. 1. The golfer 11 is gripping a golf club 12 with his hands 13 and is wearing a belt 14 which is removably attached to the golfer 11 and to a hook and loop strip 16 on the golf training apparatus 10 to form part of the training apparatus 10. The belt 14 has a strip of VELCRO or hook and loop material 15 which may be either the hook or loop material as desired mounted along one side thereof. The hook and loop material 15 is positioned on the back of the golfer so as to attach to the strip of hook and loop material 16 attached to the apparatus 10. A separate strip of hook and loop material may be used as a belt extender for larger golfers. The apparatus 10 has a base frame 17 which may be made of plastic pipe, such as PVC pipe, and has two side spacing members 18 and 20 which can be used for the golfer 11 to align his feet 21. The base frame 17 has an upright frame portion 22 supporting a cross support member 23. Cross support member 23 has a pair of angled telescoping brace members 24 with a screw lock 25 for locking the telescoping members in any desired position. The telescoping member 24 is connected to base frame member 20 while a second telescoping bracing member 26 extends from the cross support member 23 to the base member 18. A pair of horizontally extending support members 27 and 28 are also telescoping members which may be locked with a screw lock 30 to lock the telescoping member in any position desired. A pair of front supporting members 31 and 32 are vertically telescoping members having a screw lock 33 for locking the telescoping members in any telescoped positioned. The vertically extending front support members 31 and 32 are connected to a base support frame 34 which is connected to the base frame portion 35 having a pair of telescoping support members 36 with a screw lock 37.

The front part 38 of the training apparatus 10 can be moved in and out with the telescoping members 27, 28, 36, and 41. Also, the frame can be adjusted up and down with the telescoping member 31 and 32 and the angle of the frame can be adjusted with the telescoping brace members 24 and 26 which are attached to the cross support member 23 with a collar 42 at one end and with a collar 43 attached to an extension 44 attached to the base member 20. Similarly, the upright members 45 are mounted to the cross frame member 23 with a collar 46 and are attached to a bottom cross frame member 47 with a collar 48.

A knee brace members 50 includes an extension pipe 51 adjustably attached with a screw lock 52 to a collar 53, which collar is attached to the upright frame member 31. The end portion 54 can be adjusted for the side of the golfer 11 knee while knee brace member 55 can be adjusted for the back of the golfer's knee to give the golfer the proper stance between the knee support and the foot positioning portions and, in addition, the golfer has the belt 14 attached to him with the hook and loop material 15 on the back thereof removably attached to a piece of hook and loop material 16. The removably attached belt 14 worn by the golfer to the hook and loop material 16 supports the golfer's rear portion or tail to the apparatus 10. During a practice swing, the belt hook and loop material will pull loose on one side during a swing to control a golfer's swing.

A telescoping back aligning member 57 has a screw lock 58. The back aligning member 57 is placed at a posture angle for the golfer to align his back with the correct posture for a golf stroke and is adjustably for an individual golfer. A head stabilizing portion 60 is attached to the end of the telescoping member 57 and has a sliding arm 61 which can be fixedly attached with the screw fastener 62 to slide a head support plate 63 on the end of the arm 61 to a position to support the side of a golfer's head 64, as seen in FIG. 1. The support member 63 has the side of the head support 64 on one side thereof and a second head support 65 on the other side and can be rotated and positioned for the top of the golfer's head as desired.

In practice, the golfer would put on the belt 14 and adjust the apparatus for his body and attach the lower body and tail portion with the belt 14 having the hook and loop material 15 attached to the hook and loop material 16 on the apparatus 10. He can also adjust the knee brace members 50 for the back and side support of the knees in the proper bent position and can align his feet 21 with the base frame members. Simultaneously, he can adjust the posture angle of the back alignment member 57, such as to a 20 degree angle, and adjust the head stabilizer 60 to a position to support either the side or top of the golfer's head 64. In these positions, the golfer can practice his swing while being supported in the correct posture position for making a golf practice swing. He can thereby make repeated swings while being supported in the proper position for training the golfer in making a swing.

It should be clear that the present invention however is not to be construed as limited to the forms shown which are to be considered illustrative rather than restrictive.

I claim:

1. A golf training apparatus comprising:

a frame having a base and an upright frame portion having a cross frame member;

a back support attached to said upright frame portion and positioned to support the back of a golfer making practice swings, said back support having an elongated hook and loop fastener portion thereon;

a belt for attaching around a golfer and having a fastener portion positioned in the back thereof and aligned for attachment to said back support fastener portion to thereby removably hold a golfer making practice springs to said golf training apparatus;

whereby a golfer can be held in a desired position to a golf training apparatus while making practice swings.

2. The golf training apparatus in accordance with claim 1 having a pair of knee brace members attached to and extending from said frame upright frame portion for holding a golfer's knees in position when making a practice swing.

3. The golf training apparatus in accordance with claim 2 in which said upright frame portion has a plurality of telescoping frame members for adjusting said golf training apparatus to a golfer making practice swings.

4. The golf training apparatus in accordance with claim 3 in which each said knee brace member has a knee side member and a knee back member.

5. The golf training apparatus in accordance with claim 3 in which each said knee brace member is adjustably attached to said frame for adjusting to a golfer making practice swings.

6. The golf training apparatus in accordance with claim 1 in which said belt fastener portion is an elongated strip of hook and loop material which removably attaches to said back support elongated hook and loop fastener portion so as to partially separate when a golfer makes a practice swing thereby applying releasable force to the golfer as he swings a golf club.

7. The golf training apparatus in accordance with claim 1 having an elongated head supporting arm attached to and extending from said frame to an area adjacent a golfer's head.

8. The golf training apparatus in accordance with claim 7 having a head supporting yoke attached to one end of said elongated head supporting arm for fitting around a golfer's head.

9. The golf training apparatus in accordance with claim 8 in which said head supporting yoke is attached to one end of said elongated head supporting arm for fitting around the back of a golfer's head.

10. The golf training apparatus in accordance with claim 8 in which said head supporting yoke is attached to one end of said elongated head supporting arm for fitting over the top of a golfer's head.

11. The golf training apparatus in accordance with claim 8 in which said elongated head supporting arm is a telescoping arm for adjusting to a golfer making a practice swing.

12. The golf training apparatus in accordance with claim 11 in which said head supporting yoke is attached to a yoke arm having a telescoping attachment to said elongated head supporting arm for adjusting to a golfer making a practice swing.

13. The golf training apparatus in accordance with claim 1 in which said belt has a hook and loop fastener buckle.

* * * * *